United States Patent [19]

Couch et al.

[11] Patent Number: 4,556,017

[45] Date of Patent: Dec. 3, 1985

[54] FLUIDIZED BED COMBUSTION APPARATUS

[75] Inventors: Alan T. Couch, Carshalton; Terence D. Cruickshank, Bromley, both of England; William L. E. Davey, Modderfontein, South Africa; Anthony R. Marshall, Horsham, England; Christopher B. Tydd; David R. Wakeford, both of East Grinstead, England

[73] Assignee: Fluidised Combustion Contractors Limited, Sussex, England

[21] Appl. No.: 697,125

[22] PCT Filed: Jun. 1, 1984

[86] PCT No.: PCT/GB84/00190

§ 371 Date: Jan. 31, 1985

§ 102(e) Date: Jan. 31, 1985

[87] PCT Pub. No.: WO84/04954

PCT Pub. Date: Dec. 20, 1984

[30] Foreign Application Priority Data

Jun. 3, 1983 [GB] United Kingdom ..... 8315215

[51] Int. Cl.[4] ..... F22B 1/02

[52] U.S. Cl. ..... 122/4 D; 110/234; 110/238; 110/245; 122/22

[58] Field of Search ..... 122/4 D, 2, 22; 110/238, 245, 234; 165/104.16; 431/170

[56] References Cited

U.S. PATENT DOCUMENTS

| | | | |
|---|---|---|---|
| 4,312,302 | 1/1982 | Kollerup | 122/4 D |
| 4,426,958 | 1/1984 | Hosek et al. | 122/4 D |
| 4,436,507 | 3/1984 | Stewart et al. | 431/170 |
| 4,449,482 | 5/1984 | Leon et al. | 122/4 D |

*Primary Examiner*—Edward G. Favors

*Attorney, Agent, or Firm*—Kemon & Estabrook

[57] ABSTRACT

A fluidized bed furnace and boiler for the combustion of flyash with a moisture content of 45% by weight. The flyash is produced as a by-product of a coal gasification process and transported in water to a slime dam. From the slime dam a slurry of flyash and water is initially thickened in a gravity thickener (1) (FIG. 1) and then converted to filter cake in a tubular filter press (4). The filter cake is fed through pressurized hoppers (8) and chutes to the base of the boiler (10) and is distributed across the floor through chutes in the side walls and through chutes surrounded by a tubular array of water tubes and extending into the boiler furnace chamber terminating approximately one quarter of the furnace width from the side walls. A fluidized bed with a depth of about 3 meters is formed by discharging air heated in an associated air heater through nozzles in the floor of the furnace chamber to effect combustion. The combustion gases are utilized to produce steam in the boiler and are passed through a grits separator (32) and bag filter (34) before discharge through a flue (36).

10 Claims, 4 Drawing Figures

FLUIDIZED BED COMBUSTION APPARATUS

DESCRIPTION

This invention relates to fluidised bed combustion apparatus and, more particularly, to apparatus adapted to consume a slurry of water and flyash with a carbon content of around 45% by weight.

Such a flyash is produced as a by-product of a coal gasification process and commonly is formed into a slurry for ease of removal and disposal in slime dams. Upon recovery from the slime dams, the flyash is in the form of a slurry with a high water content and as such poses difficult transportion and disposal problems.

In a fluidised bed combustion apparatus arranged to be fired by flyash according to the present invention there is provided a furnace chamber having tubulous walls, floor and roof connected to extend between distributor means subjacent the base of the furnace chamber and collector means adjacent the roof of the furnace chamber, a lateral gas pass extending from an upper region of the furnace chamber containing a vapour generating tube bank extending between a lower, liquid, drum and an upper, vapour and liquid, drum connected to the collectors, a down pass extending from the lateral gas pass containing an economiser tube bank and an airheater and having at the base thereof a grits hopper, the downpass discharging through a bag filter means to a flue, flyash firing means including chutes discharging through ports in the furnace chamber walls closely superjacent the floor and inclined chutes extending through the furnace chamber walls at an intermediate level to discharge closely superjacent the floor at locations spaced from the walls, the inclined chutes being surrounded by tube lengths extending from the floor connected into respective tubulous walls, and a windbox subjacent the floor discharging fluidising air from the airheater through nozzles extending through the floor.

The invention will now be described, by way of example, with reference to the accompanying, partly diagrammatic, drawings, in which.

Figure 1:
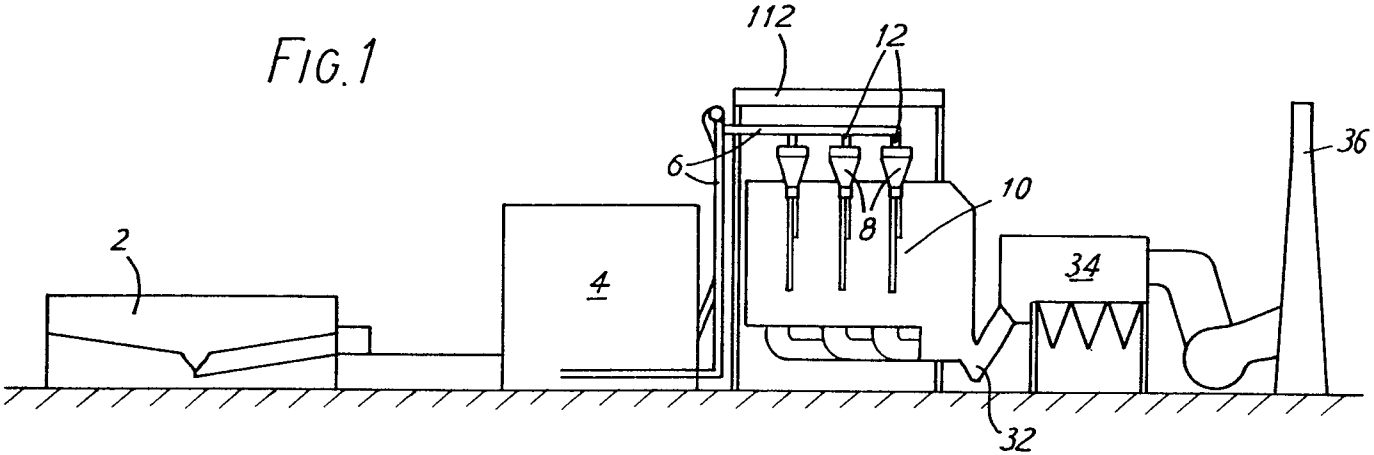
FIG. 1 is a side elevation of the plant, including a boiler.
Figure 2:
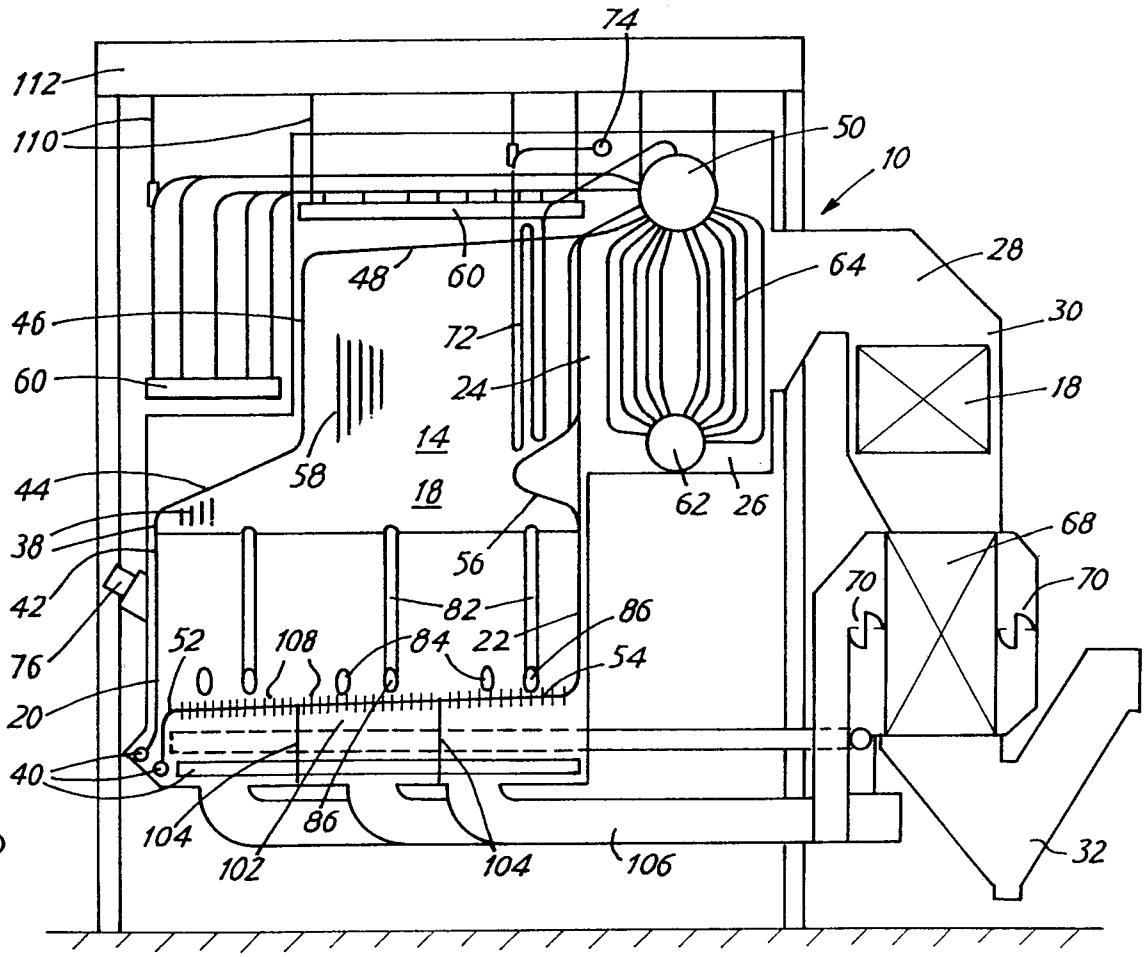
FIG. 2 is a sectional side elevation of the boiler.
Figure 4:
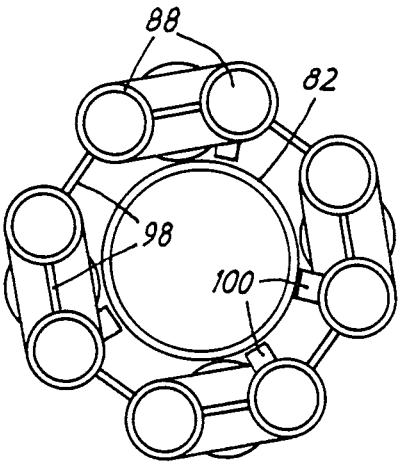
FIG. 4 is a cross-section taken on the line IV—IV of FIG. 3.
Figure 3:
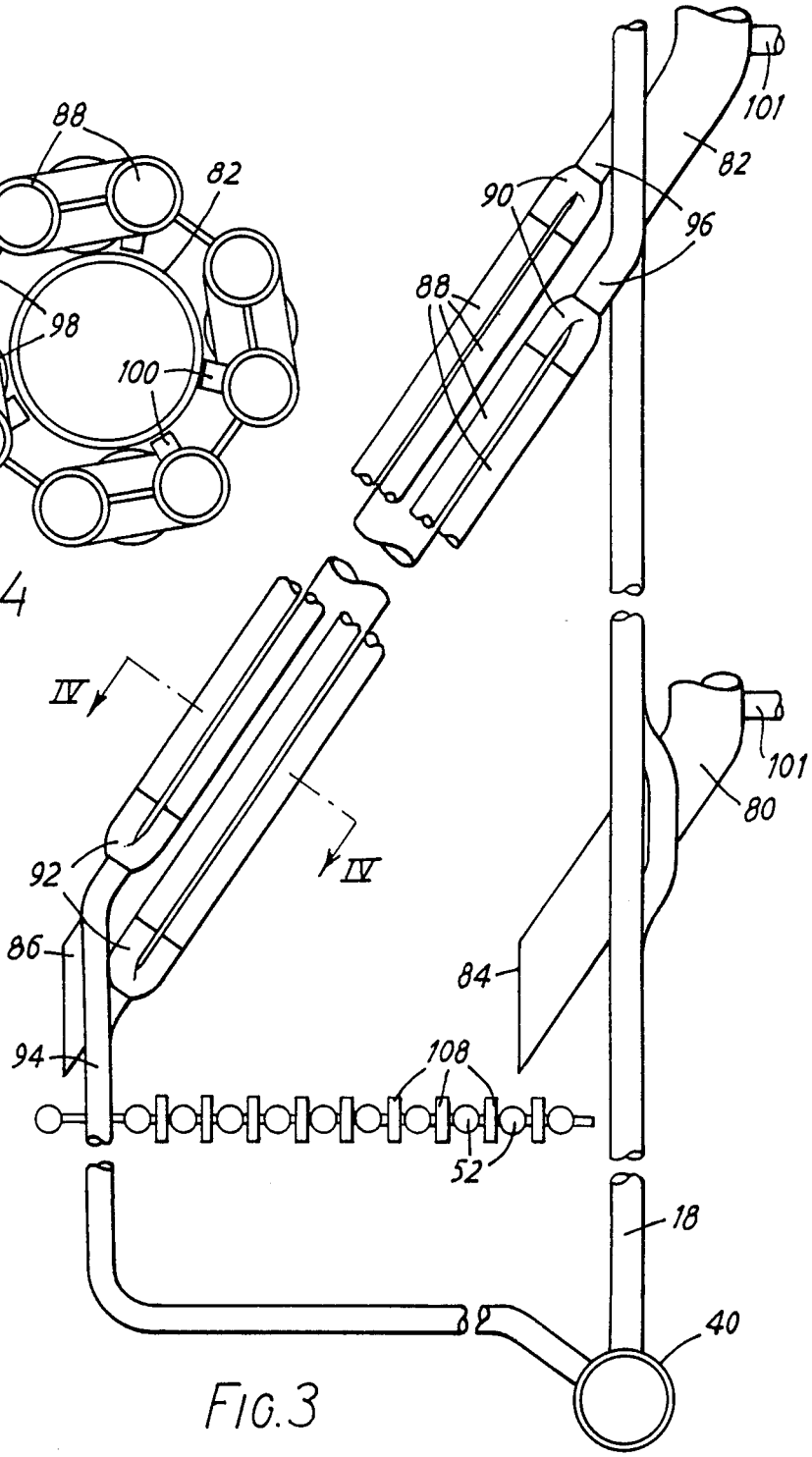
FIG. 3 is a portion of the boiler to an enlarged scale.

As shown in the drawings, a flyash slurry, produced in the gasification of coal using the Koppers-Totzek process in ammonia manufacture, is first fed to a conventional gravity thickener 2 in order to increase its density such that it then may be fed economically to a pressure filter 4 of a tubular type operating at 100 bar to produce a filter cake of low moisture content, about 40% by weight, having good handling and storage properties.

Upon discharge from the filter the cake is transported by means of drag link and pneumatic conveyors 6 to be pressurised feed hoppers 8 located adjacent an upper region of a fluidised bed fired boiler 10. Filter cake is admitted to the hoppers through rotary valve seals 12 and metered into a furnace chamber 14 of the fluidised bed fired boiler by means of drag link feeders 16.

The furnace chamber 14 of the boiler 10 is of rectangular cross-section in plan, having side walls 18 of greater width than the front and rear walls 20, 22. A combustion gas outlet 24 is formed in the upper part of the rear wall and discharges to a lateral gas pass 26 connected, through a 90° bend 28, to a down pass 30 having at the base thereof a grits hopper 32 which discharges, through a bag filter 34, to a flue 36. The furnace chamber is lined with contiguously welded finned tube panels 38 extending upwardly from distributors 40 at the respective bases of the front wall 20 and the side walls 18. A first group of tubes 42 extends upwardly in the front wall from a first distributor 40 at the base thereof to an intermediate level where the tubes are bent inwardly and upwardly to form an intermediate front roof portion 44 and then bent again to form an upper wall portion 46. At the top of the furnace chamber the tubes of the upper wall portion are bent to form an upwardly sloping roof portion 48 discharging to a steam and water drum 50, situated above the lateral gas pass 26 and provided with steam and water separating means (not shown). A second group of tubes 52 extends from a second distrib 40 at the base of the front wall 20 to the base of the rear wall 22 as a sloping floor 54 to the furnace chamber. At the base of the rear wall, the tubes are bent upwardly to form the rear wall. At the level of the intermediate front roof portion 44, alternate tubes are bent inwardly and upwardly out of the plane of the rear wall to form a nose arch 56. The tubes are further bent upwardly and outwardly across the lateral gas pass 26 and discharge to the steam and water drum 50. Groups of tubes 58 extend upwardly in the side walls 18 from the distributors 40 at the bases thereof to collectors 60 adjacent the intermediate roof portion 44 and adjacent the furnace chamber roof 48, which collectors are connected to discharge to the steam and water drum 50. A water drum 62 is positioned at the base of the lateral gas pass 26, subjacent the steam and water drum 50, and an evaporator tube bank 64 extends upwardly across the lateral gas pass between the two drums.

An economiser tube bank 16 is positioned in the down pass 30 superjacent an air heater 68 provided with bypass dampers 70.

Pendant superheater platens 72 positioned superjacent the nose arch 56 are connected to receive steam from the steam and water drum 50 and discharge steam through a superheater steam main 74.

The walls of the furnace chamber below the level of the intermediate front roof portion 44 and the nose arch 56 are lined with refractory material and are formed with penetrations for lighting-up burners 76 and for filter cake discharge. The filter cake hoppers 8 discharge, through variable speed drag link feeders 16, to chutes 78 which each bifurcate at an upper level to form pairs of discharge chutes 80, 82 respectively discharging through inclined portions terminating in ports 84 in the side walls at the level of the furnace chamber floor 54 and extending downwardly at an acute angle through the side walls 18 at the level of the intermediate front roof portion 44 to a level adjacent the furnace chamber floor discharging through outlets 86 spaced inwardly of the side walls at approximately one quarter of the furnace width. The inclined discharge chutes 82 extending into the furnace chamber are provided with tubulous water cooling means consisting of eight tubes 88 extending alongside each chute connected in pairs into bifurcations 90, 92 at the upper and lower ends thereof. The lower bifurcations 92 are connected to four riser tubes 94 extending through the furnace chamber floor 54 and the upper bifurcations 90 are connected to four tubes 96 which are then bent to extend in the plane of the adjoining side wall 18. Strips 98 are welded intermediate adjacent tubes 88 such that a tubular enclosure is formed around the associated chute 82, which is supported and located on upper and lower groups of four wear pads 100 welded to four of the eight tubes 88. Air discharge nozzles 101 are positioned in the chutes adjacent transitions from upright to inclined portions to assist the discharge of filter cake into the furnace chamber.

The base portion of the furnace chamber 14, below the sloping floor, is formed as a windbox 102 partioned by two laterally extending division walls 104 into three, approximately equal, sections connected by ducts 106 provided with control dampers (not shown) to a forced draught fan (not shown) through the air heater 68. Air nozzles 108 are positioned at spaced intervals penetrating the contiguously welded fins between the tubes forming the furnace floor for the discharge of air from the windbox into the base of the furnace chamber to form a fluidised bed.

The boiler is top-supported by means of slings 110 depending from a steelwork frame 112.

In operation, flyash slurry from the gravity thickener 2 is partially dried, to a moisture content of approximately 40% by weight, in the tubular press filters 4 and fed, through crushers, to the hoppers 8 adjacent the boiler by means of the drag link and pneumatic conveyors 6, the rate of feed being controlled in accord with signals from high and low level sensors on the hoppers. The partially dried flyash filter cake is discharged from the base of each hopper 8 at a controlled rate using the associated variable speed drag link feeder 16, into the respective chute 78. The filter cake is discharged into the furnace chamber, adjacent the sloping floor 54, with the assistance of air discharge through the nozzles at the upper ends, and at locations spaced approximately at one quarter of the chamber width. Combustion occurs at a temperature of approximately 1000° C. and 25% excess air in the bed in the furace chamber fluidised to a bed depth of approximately three meters. Combustion is substantially completed in the gases discharged from the bed in the remaining portion of the furnace chamber and the combustion gases are discharged over the pendant superheater bank 72, through the lateral gas pass 26, over the evaporator tube bank 66, through the down pass 30 and grits hopper 32 to the bag filters 34 and flue 36.

Start-up is effected by fluidising the portion of the bed adjacent the front wall 20 and firing the four lighting-up burners 76 to raise the bed temperature to a temperature at which combustion of the flyash filter cake is self sustaining. Slurry is then fed through the two chutes 78 adjacent the front wall and the bed conditions of the portion stabilised. The central portion of the windbox 102 is then supplied with air to fluidise the superjacent portion of the bed and filter cake feed commenced through the two chutes 78 associated therewith. Finally, upon the front and central portions of the bed reaching stable conditions, the portion of the windbox 102 adjacent the rear wall 22 is supplied with air to fluidise the rear portion of the bed and filter cake feed commenced through the two chutes 78 adjacent the rear wall 22 until the complete bed is operating stably.

Part load operation of the bed is achieved by slumping one or two of the portions of the bed by closing the control dampers in the ducts supplying air to the respective portions of the windbox 102.

Heat transferred from the combustion gases to the various tube surfaces serves to generate and superheat steam for utilisation elsewhere in the plant.

We claim:

1. A fluidised bed combustion apparatus arranged to be fired by flyash including a furnace chamber (14) having tubulous walls (18, 20, 22), floor (54) and roof (44, 48) connected to extend between distributor means (40) subjacent the base of the furnace chamber and collector means (60) adjacent the roof of the furnace chamber, a lateral gas pass (26) extending from an upper region of the furnace chamber containing a vapour generating tube bank (64) extending between a lower, liquid, drum (62) and an upper, vapour and liquid, drum (50) connected to the collectors, a down pass (30) extending from the lateral gas pass containing an economiser tube tank (16) and an airheater (68) and having at the base thereof a grits hopper (32), the downpass discharging through a bag filter means (34) to a flue (36), characterised in that means for firing the flyash include chutes (80) discharging through ports in the furnace chamber walls (18) closely superjacent the floor (54) and inclined chutes (82) extending through the furnace chamber walls (18) at an intermediate level to discharge closely superjacent the floor (54) at locations spaced from the walls, the inclined chutes being surrounded by tube lengths (88) extending from the floor (54) connected into respective tubulous walls (18), and a windbox (102) subjacent the floor discharging fluidising air from the airheater (68) through nozzles (108) extending through the floor to form a fluidised bed of the flyash.

2. A fluidised bed combustion apparatus as claimed in claim 1, characterised in that the flyash in the form of a slurry consisting of a mixture of water and flyash is arranged to be partially dried in tubular presses (4) prior to discharge to the furnace chamber (14).

3. A fluidised bed combustion apparatus as claimed in claim 2, characterised in that the chutes (80) and inclined chutes (82) are connected to receive the partially dried flyash from pressurized hoppers (8) through enclosed, cariable speed, drag link feeder means (6).

4. A fluidised bed combustion apparatus as claimed in claim 3, characterised in that the pressurized hoppers (8) are connected to receive the partially dried flyash through rotary valves (12).

5. A fluidised bed combustion apparatus as claimed in claim 3, characterised in that each pressurized hopper (8) has associated therewith one chute (80) and one inclined chute (82) discharging at locations equidistant from the furnace chamber front wall (20).

6. A fluidised bed combustion apparatus as claimed in claim 1, characterised in that the windbox (102) is formed as a plurality of compartments by division walls (104), each compartment being connected to receive air from the air heater through respective damper controlled ducts (106).

7. A fluidised bed combustion apparatus as claimed in claim 6, characterised in that each compartment has associated therewith two pressurized hoppers (8), one to each side of the furnace chamber (14), each pressurized hopper having associated therewith one chute (80) and one inclined chute discharging at locations superjacent the compartment.

8. A fluidised bed combustion apparatus as claimed in claim 6, characterised in that lighting-up burners (78) are positioned in the furnace chamber walls (20) to discharge into a furnace chamber region superjacent one of the windbox compartments.

9. A fluidised bed combustion apparatus as claimed in claim 1, characterised in that the tubulous walls (18,20,22), floor (54) and roof (44,48) of the furnace chamber are formed from contiguously welded finned tube panels (38).

10. A fluidised bed combustion apparatus as claimed in claim 9, characterised in that the nozzles (108) extending through the floor extend through and are welded to finned portions of the respective panels.

* * * * *